US008068778B2

(12) United States Patent
Kaino et al.

(10) Patent No.: US 8,068,778 B2
(45) Date of Patent: Nov. 29, 2011

(54) IMAGE HEATING APPARATUS AND ENDLESS BELT USED FOR IMAGE HEATING APPARATUS

(75) Inventors: Toshiya Kaino, Suntou-gun (JP); Akihito Kanamori, Yokohama (JP); Hiroto Hasegawa, Mishima (JP); Satoru Taniguchi, Mishima (JP); Takashi Honke, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 406 days.

(21) Appl. No.: 12/417,283

(22) Filed: Apr. 2, 2009

(65) Prior Publication Data

US 2009/0257794 A1 Oct. 15, 2009

(30) Foreign Application Priority Data

Apr. 9, 2008 (JP) ..... 2008-101398

(51) Int. Cl.
*G03G 15/20* (2006.01)

(52) U.S. Cl. ..... 399/329; 399/320; 399/328; 399/122

(58) Field of Classification Search ..... 399/329
See application file for complete search history.

(56) References Cited

U.S. PATENT DOCUMENTS

| | | | | |
|---|---|---|---|---|
| 5,210,579 | A | 5/1993 | Setoriyama et al. | 355/285 |
| 5,525,775 | A | 6/1996 | Setoriyama et al. | 219/216 |
| 6,075,228 | A | 6/2000 | Goto et al. | 219/216 |
| 6,085,058 | A | 7/2000 | Goto et al. | 399/313 |
| 6,459,878 | B1 | 10/2002 | Tomoyuki et al. | 399/331 |
| 6,493,521 | B2 | 12/2002 | Miyamoto et al. | 399/44 |
| 6,561,001 | B2 | 5/2003 | Sakuma et al. | 72/85 |
| 6,671,488 | B2 | 12/2003 | Izawa et al. | 399/329 |
| 6,701,102 | B2 | 3/2004 | Hasegawa et al. | 399/69 |
| 6,748,192 | B2 | 6/2004 | Izawa et al. | 399/329 |
| 6,787,737 | B2 | 9/2004 | Uekawa et al. | 219/216 |
| 6,794,611 | B2 | 9/2004 | Kataoka et al. | 219/216 |
| 6,898,397 | B2 | 5/2005 | Sakuma et al. | 399/159 |
| 6,915,099 | B2 | 7/2005 | Izawa et al. | 399/328 |
| 6,920,293 | B2 | 7/2005 | Izawa et al. | 399/67 |
| 6,944,420 | B2 | 9/2005 | Kanamori et al. | 399/329 |
| 7,283,780 | B2 | 10/2007 | Uchida et al. | 399/329 |

FOREIGN PATENT DOCUMENTS

| | | |
|---|---|---|
| JP | 4-44075 | 2/1992 |
| JP | 5-19647 | 1/1993 |
| JP | 10-319753 | 12/1998 |
| JP | 2001-117396 | 4/2001 |
| JP | 2001-225134 | 8/2001 |

(Continued)

*Primary Examiner* — David Gray
*Assistant Examiner* — David Bolduc
(74) *Attorney, Agent, or Firm* — Fitzpatrick, Cella, Harper & Scinto

(57) ABSTRACT

The image heating apparatus for heating an image formed on a recording medium has an endless belt with a base layer made of a metal material; a heater that contacts with an inner surface of the endless belt; and a backup member that forms a nip portion together with the heater through the endless belt. The image formed on the recording medium is heated while being pinched and conveyed in the nip portion. An end surface of the base layer includes a plane region and a curved surface region. When the thickness of the base layer is t, the width of the plane region in a thickness direction of the base layer is h, and the flatness ratio H of the end surface of the base layer is defined as h/t, the flatness ratio H satisfies 50%≦H≦90%.

8 Claims, 8 Drawing Sheets

FOREIGN PATENT DOCUMENTS

| | | | |
|---|---|---|---|
| JP | 2002-323821 | | 11/2002 |
| JP | 2003084592 | A * | 3/2003 |
| JP | 2005-156918 | | 6/2005 |
| JP | 2006-293225 | | 10/2006 |

* cited by examiner

IMAGE HEATING APPARATUS AND ENDLESS BELT USED FOR IMAGE HEATING APPARATUS

BACKGROUND OF THE INVENTION

1. Field of the Invention

The present invention relates to an image heating apparatus that can be used as a heating and fixing apparatus (fixing unit) mounted to an image forming apparatus, such as an electrophotographic copying machine or an electrophotographic printer, and an endless belt used for an image heating apparatus.

2. Description of the Related Art

A film-heating-type fixing device has been known for use in a heating and fixing apparatus (fixing unit) that is mounted to an image forming apparatus, such as an electrophotographic copying machine or an electrophotographic printer. Japanese Patent Application Laid-Open No. H04-044075 discloses this type of heating and fixing apparatus. The heating and fixing apparatus includes a heater that has an electric heating resistor layer formed on a ceramic substrate, a fixing film (endless belt) that is moved while contacting the heater, and a pressure roller that contacts the fixing film to form a nip portion. A recording material having a non-fixed toner image carried thereon is heated while being pinched and conveyed in the nip portion of the heating and fixing apparatus. Then, the toner image formed on the recording material is fixed to the recording material by heat. This type of heating and fixing apparatus has an advantage in that, after the supply of power to the heater starts, the temperature of the heater increases up to a toner image fixable temperature in a short time. Therefore, a printer provided with the heating and fixing apparatus has a short first print out time (FPOT) after a print instruction is input. In addition, this type of heating and fixing apparatus has an advantage in that power consumption is small while it waits for the input of a print instruction.

The heating and fixing apparatus of the film heating type needs to rapidly heat the non-fixed toner image formed on the recording material to fix it to the recording material, in order to correspond to an increase in the process speed of a copying machine or a printer.

As described in Japanese Patent Application Laid-Open Nos. H10-319753 and 2001-225134, a thick sleeve that is made of a metal material having high thermal conductivity instead of a heat-resistant resin is used as a base layer of a fixing film to improve the heat transfer efficiency of a recording material.

In the heating and fixing apparatus of the film heating type, in some cases, while the fixing film is being rotated, deviation occurs in the fixing film in the longitudinal direction thereof. It is difficult to control the deviation force. In particular, when there is a large difference in parallelism between the pressure roller and the fixing film or when there is a large difference in pressing force between both ends of the fixing film and the pressure roller in the longitudinal direction, strong deviation force is applied to the fixing film. Then, strong stress is applied to the end of the film from which the deviation force is generated. In this case, the end of the fixing film is likely to be damaged.

Japanese Patent Application Laid-Open No. 2002-323821 discloses a structure in which a film end regulating surface of a fixing flange regulates the movement of the end of a fixing film to prevent the deviation of the fixing film.

In the heating and fixing apparatus of a film heating type, when a thick metal sleeve is used as the base layer of the fixing film, the following problems are likely to arise.

In order to achieve a heating and fixing apparatus capable of corresponding to an increase in the process speed of an image forming apparatus, generally, a pressing unit that applies pressure to a nip portion is reinforced to ensure a fixing property. When the pressing unit is reinforced to increase pressure applied to the nip portion, deviation force is increased due to a difference in parallelism between the pressure roller and the fixing film or unevenness in the thickness of an elastic layer provided on the pressure roller.

When the life span of the heating and fixing apparatus is increased, sliding friction continuously occurs between a protective sliding layer of the heater and the inner circumferential surface of the base layer of the fixing film for a long time. As a result, the surface properties of the protective sliding layer and the inner circumferential surface of the base layer deteriorate, and the friction therebetween is increased. When the friction is increased, the deviation force applied to the fixing film is increased.

As such, with an increase in the process speed and the life span of the heating and fixing apparatus, deviation force applied to the end surface of the base layer of the fixing film is increased. However, the shape of the end surface of the base layer is not considered. The fixing film deviates in the longitudinal direction by the deviation force, but the deviation of the fixing film is regulated by the end regulating surface of the fixing flange. When the deviation force is increased, strong stress is applied to the end surface of the base layer.

When the entire end surface of the base layer of the fixing film is rounded, the contact area between the end surface of the base layer and the end regulating surface of the fixing flange is reduced.

FIG. 10 is a diagram illustrating the contact between a base layer end surface 71*a* of a fixing film 71 and an end regulating surface 76 of a fixing flange 75 when the base layer end surface is rounded.

When the fixing film is operated for a long time in the state shown in FIG. 10, the base layer end surface 71*a* does not endure strong deviation force since the base layer end surface 71*a* of the fixing film 71 comes into point contact with the regulating surface. As a result, the fixing film 71 is likely to be damaged.

When the edge of the end surface of the base layer of the surface fixing film is not rounded, the contact area between the end surface of the base layer of the fixing film and the end regulating surface of the fixing flange is large.

FIG. 11A is a diagram illustrating the contact between the base layer end surface 71*a* and the end regulating surface 76 of the fixing flange 75 when an edge 71*a*1 of the base layer end surface 71*a* of the fixing film 71 is not rounded. FIG. 11B is a diagram illustrating the contact between a portion of the edge 71*a*1 of the base layer end surface 71*a* of the fixing film 71 shown in FIG. 11A and the end regulating surface 76 of the fixing flange 75.

As shown in FIG. 11A, when the edge 71*a*1 of the base layer end surface 71*a* of the fixing film 71 is not rounded, the contact area between the base layer end surface 71*a* of the fixing film 71 and the end regulating surface 76 of the fixing flange is large even when a strong deviation force is applied to the fixing film 71. Therefore, the end regulating surface 76 can disperse the deviation force of the fixing film 71. However, as shown in FIG. 11B, when the fixing film 71 is not parallel to a pressure roller (not shown), a portion of the edge 71*a*1 of the base layer end surface 71*a* contacts with the end regulating surface 76 of the fixing flange 75. Then, the deviation force is concentrated on one point of the edge 71*a*1 contacted with the end regulating surface 76. Therefore, the fixing film 71 is likely to be damaged.

As described above, the shape of the end surface of the base layer of the fixing film is very important in order to prevent the damage of a film.

SUMMARY OF THE INVENTION

The invention has been made in order to solve the above-mentioned problems, and an object of the invention is to provide an image heating apparatus including an endless belt with high durability and an endless belt used for the image heating apparatus.

According to an aspect of the invention, an image heating apparatus includes: an endless belt that includes a base layer made of a metal material; a heater that contacts with an inner surface of the endless belt; and a backup member that forms a nip portion together with the heater through the endless belt. The image formed on the recording medium is heated while being pinched and conveyed in the nip portion. An end surface of the base layer includes a plane region and a curved surface region. When the thickness of the base layer is t, the width of the plane region in a thickness direction of the base layer is h, and the flatness ratio H of the end surface of the base layer is defined as h/t, the flatness ratio H satisfies $50\% \leqq H \leqq 90\%$.

According to another aspect of the invention, an endless belt includes a base layer that is made of a metal material. An end surface of the base layer includes a plane region and a curved surface region. When the thickness of the base layer is t, the width of the plane region in a thickness direction of the base layer is h, and the flatness ratio H of the end surface of the base layer is defined as h/t, the flatness ratio H satisfies $50\% \leqq H \leqq 90\%$.

Further features of the present invention will become apparent from the following description of exemplary embodiments with reference to the attached drawings.

DESCRIPTION OF THE EMBODIMENTS

Hereinafter, exemplary embodiments of the invention will be described in detail with reference to the accompanying drawings.

First Embodiment

(1) Example of Image Forming Apparatus

Figure 9:
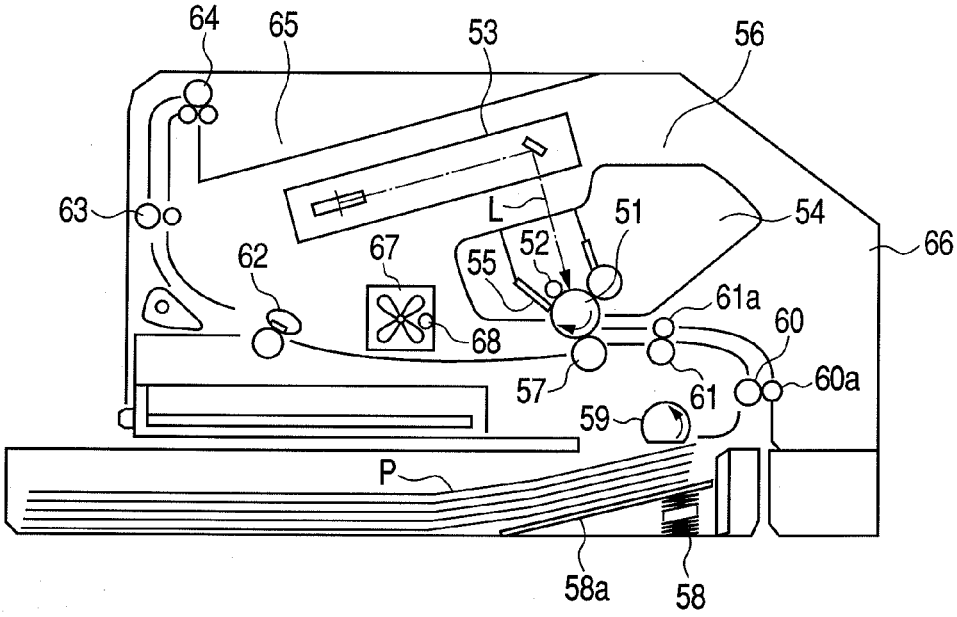
FIG. 9 is a diagram schematically illustrating the structure of an example of an image forming apparatus.
Figure 10:
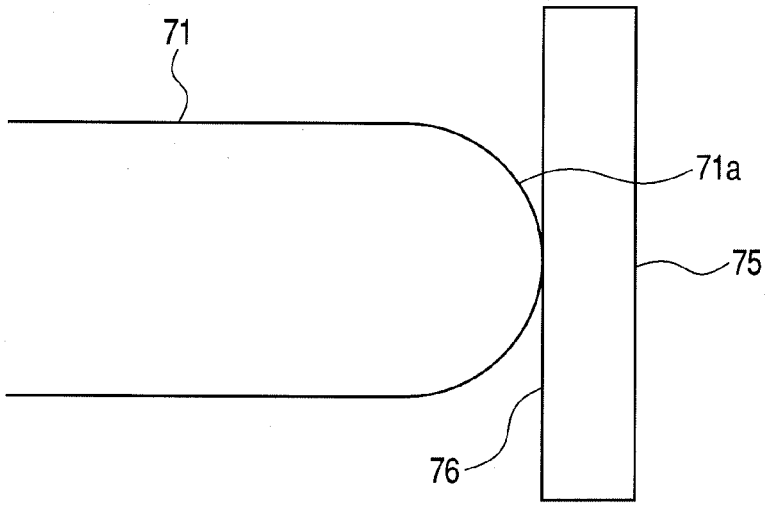
FIG. 10 is a diagram illustrating the contact between a base layer end surface of a fixing film and an end regulating surface of a fixing flange when the base layer end surface is rounded in the related art.
Figure 11A:
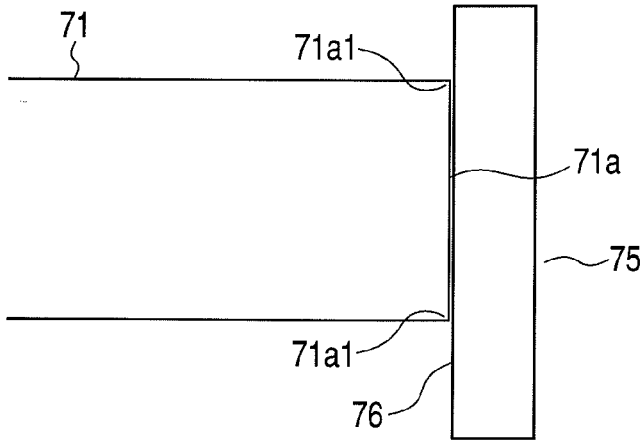
FIG. 11A is a diagram illustrating the contact between the base layer end surface and the end regulating surface of the fixing flange when the edge of the base layer end surface of the fixing film is not rounded.
Figure 11B:
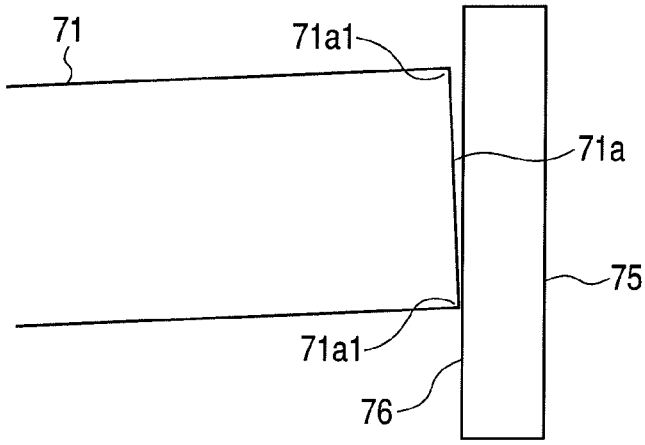
FIG. 11B is a diagram illustrating the contact between a portion of the edge of the base layer end surface of the fixing film shown in FIG. 11A and the end regulating surface of the fixing flange.

FIG. 9 is a diagram schematically illustrating the structure of an example of an image forming apparatus provided with an image heating apparatus using an endless belt. The image forming apparatus is an electrophotographic laser printer, and forms an image corresponding to image information input from an external apparatus (not shown), such as a host computer, on a recording material.

When a print instruction is input from an external apparatus, the image forming apparatus according to this embodiment rotates a drum-shaped electrophotographic photoconductor (hereinafter, referred to as a photoconductor drum) 51, serving as an image carrier, in the direction of an arrow at a predetermined speed (process speed). An outer circumferential surface (surface) of the photoconductor drum 51 is uniformly charged to have a predetermined polarity and potential by a charging unit 52. A laser scanner 53, serving as an exposure unit, writes image information on the charged surface of the photoconductor drum 51. The laser scanner 53 outputs laser light L that is modulated according to image information input from an external apparatus to the printer. The laser scanner 53 scans and exposures the charged surface of the photoconductor drum 51 with the laser light L. In this way, an electrostatic latent image corresponding to the image information is formed on the surface of the photoconductor drum 51. The electrostatic latent image is developed into a toner image (developed image) with toner (developing agent) by a developing unit 54. The toner image formed on the surface of the photoconductor drum 51 (hereinafter, referred to as a toner image) is transmitted to a transfer nip portion between the surface of the photoconductor drum 51 and an outer circumferential surface (surface) of a transfer roller 57 that is arranged opposite to the surface of the photoconductor drum 51 by the rotation of the photoconductor drum 51.

The image forming unit has the above-mentioned structure.

Recording materials (transfer sheets or OHP sheets) P loaded on a sheet loading table 58*a* of a sheet feed cassette 58 are picked up one by one by a feed roller 59 that is driven at predetermined control timing, and is conveyed to a registration portion by a conveying roller 60 and a conveying skid 60*a*. In the registration portion, the leading end of the recording material P reaches a nip portion between a registration roller 61 and a registration skid 61*a*, and the inclination of the recording material P is corrected. Then, the recording material P is fed to the transfer nip portion at predetermined conveyance timing. That is, in the registration portion, the conveyance timing of the recording material P is controlled such that, when the leading end of the toner image formed on the surface of the photoconductor drum 51 reaches the transfer nip portion, the leading end of the recording material P also reaches the transfer nip portion.

The recording material P fed to the transfer nip portion is pinched between the photoconductor drum 51 and the transfer roller 57 and then conveyed. While the recording material P is being conveyed, the toner image formed on the surface of the photoconductor drum 51 is transferred onto the recording material P by a transfer bias applied to the transfer roller 57. The recording material P having a non-fixed toner image carried thereon is separated from the surface of the photoconductor drum 51 in the transfer nip portion and then conveyed to a heating and fixing apparatus 62.

The heating and fixing apparatus 62 applies heat and pressure to the recording material P having a non-fixed toner image carried thereon in a nip portion (fixing nip portion) F, which will be described below, to heat and fix the non-fixed toner image to the recording material P. Then, the recording material P is discharged from the nip portion F.

The recording material P discharged from the nip portion F of the heating and fixing apparatus 62 is conveyed to a discharge roller 64 by an intermediate discharge roller 63. Then, the discharge roller 64 discharges the recording material P onto a discharge tray 65.

After the recording material P is separated, a cleaner 55 removes toner remaining on the surface of the photoconductor drum 51 such that the photoconductor drum is repeatedly used to form an image.

In the image forming apparatus according to this embodiment, the photoconductor drum 51, the charging unit 52, the developing unit 54, and the cleaner 55 are integrated into a process cartridge 56. The cartridge 56 is detachably mounted to an image forming apparatus body 66 forming a case of the printer.

The image forming apparatus body 66 is provided with a cooling fan 67. The cooling fan 67 is rotated at an appropriate speed to draw air into the image forming apparatus body 66, thereby cooling down a high-temperature member, such as the image forming unit or an electric substrate. A temperature detecting unit 68, such as a thermistor, is provided in the vicinity of the cooling fan 67. When air is drawn into the apparatus by the cooling fan 67, the temperature detecting unit 68 detects the temperature of an environment in which the image forming apparatus is provided. Then, the detection result is fed back to a temperature control sequence of the heating and fixing apparatus 62.

A movable regulating guide (not shown) that loads various kinds of recording materials having different sizes is provided on the sheet loading table 58*a* of the sheet feed cassette 58. The regulating guide is displaced according to the size of the recording material P to load the recording material P on the sheet loading table 58*a*. In this way, it is possible to pick up various kinds of recording materials having different sizes one by one from the sheet feed cassette 58 using the feed roller 59.

(2) Heating and Fixing Apparatus

Image Heating Apparatus

In the following description, in the heating and fixing apparatus and members of the heating and fixing apparatus, a longitudinal direction means a direction orthogonal to a direction in which the recording material is conveyed in the plane of the recording material. In addition, the longitudinal direction means a direction orthogonal to a direction in which a heating rotating body, which will be described below, is rotated. A latitudinal direction means a direction parallel to the direction in which the recording material is conveyed in the plane of the recording material. A width means a length in the latitudinal direction. In addition, the width direction of the recording material means a direction orthogonal to the direction in which the recording material is conveyed in the plane of the recording material.

Figure 1:
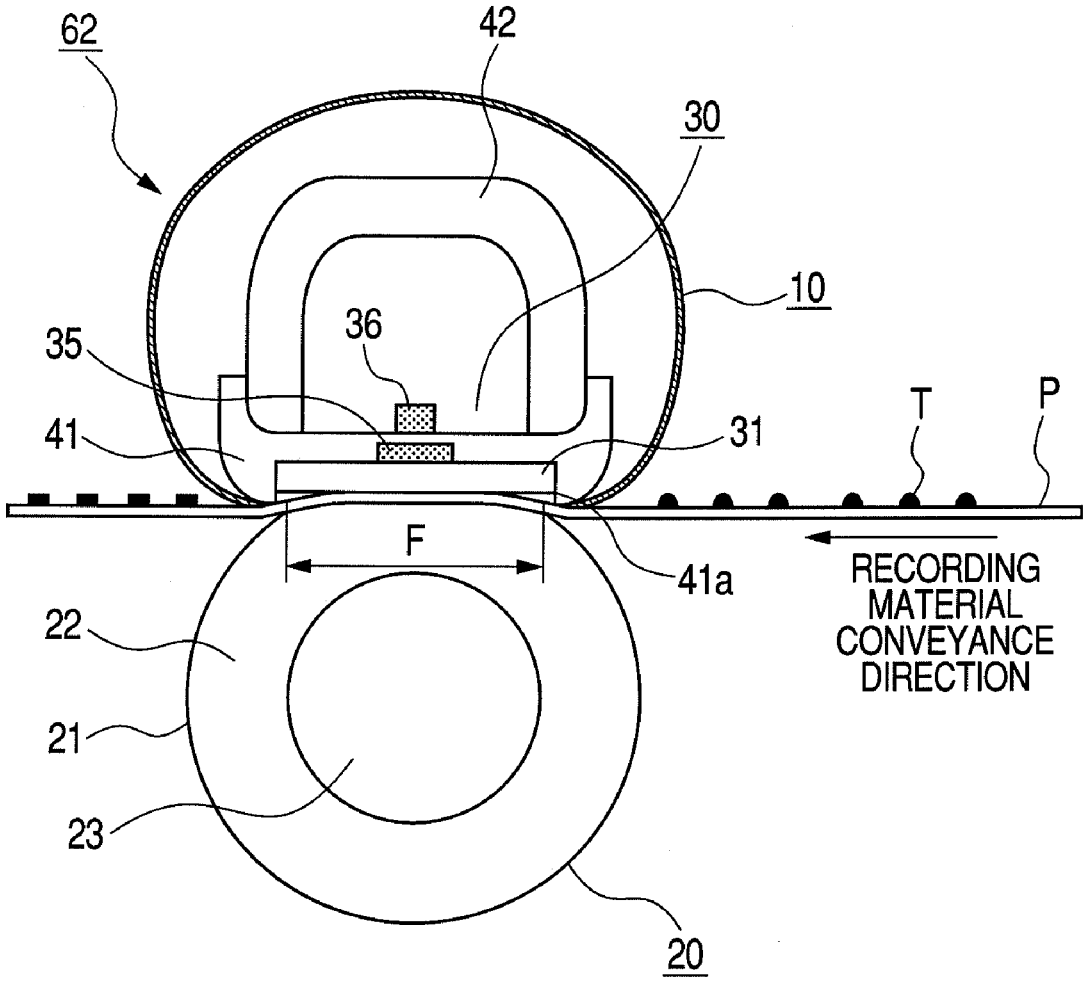
FIG. 1 is a transverse cross-sectional view schematically illustrating a heating and fixing apparatus according to a first embodiment.
Figure 2:
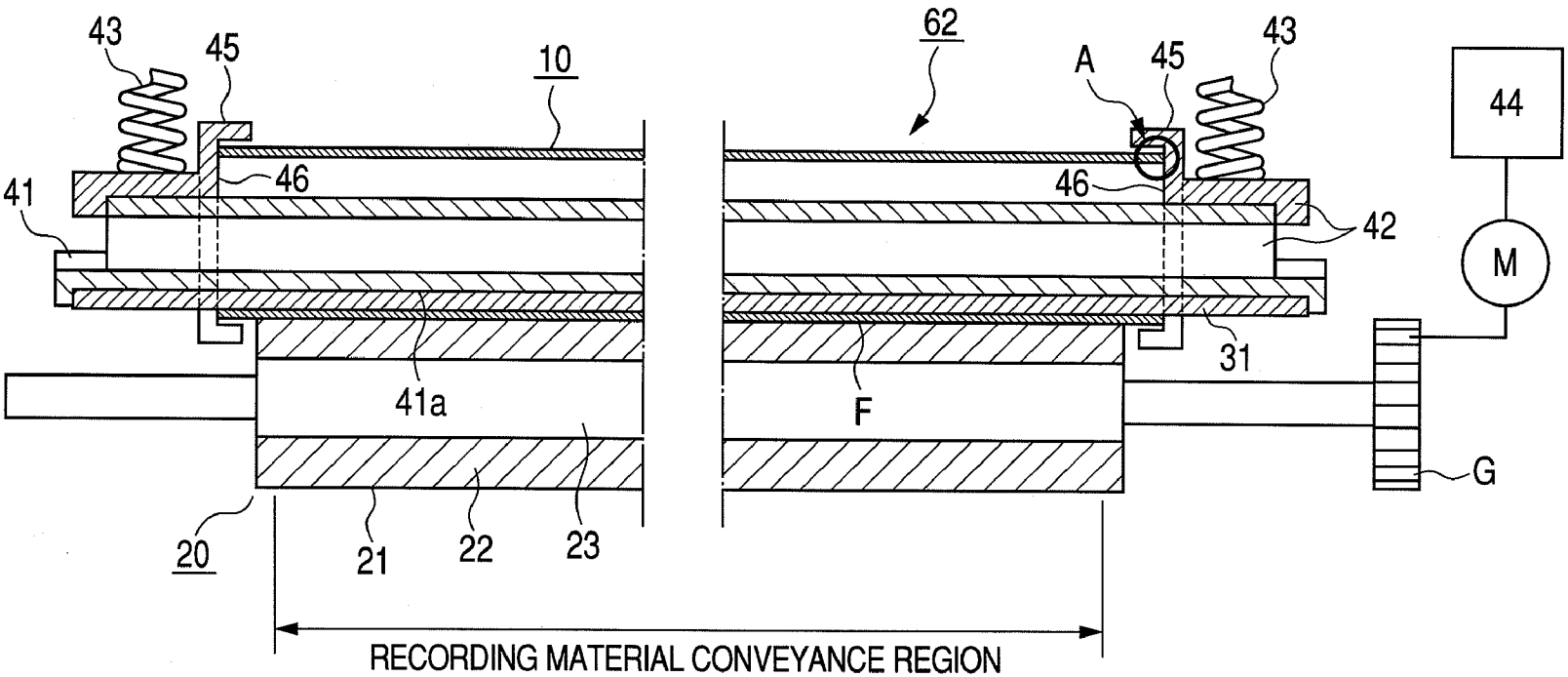
FIG. 2 is a longitudinal cross-sectional view schematically illustrating the heating and fixing apparatus according to the first embodiment.
Figure 3:
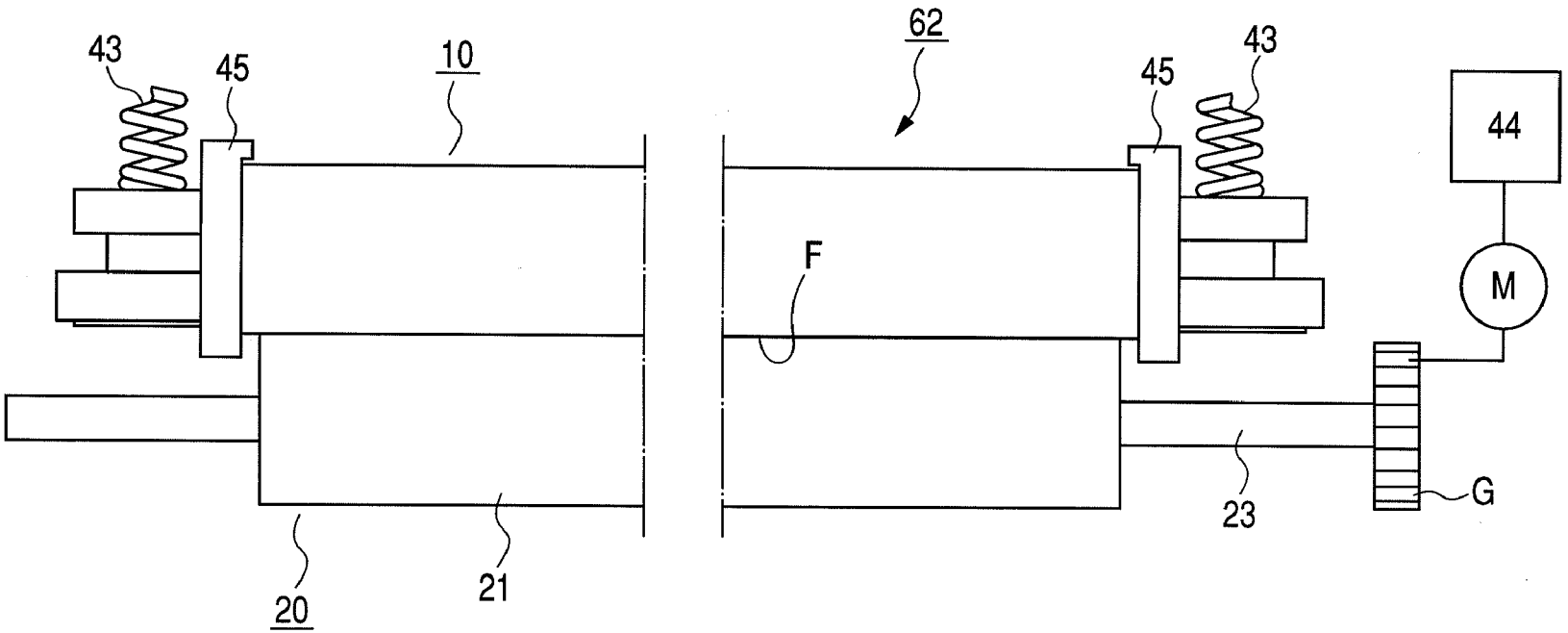
FIG. 3 is a diagram illustrating the heating and fixing apparatus according to the first embodiment, as viewed from an introduction side of a recording material.

FIG. 1 is a transverse cross-sectional view schematically the heating and fixing apparatus 62. FIG. 2 is a longitudinal cross-sectional view schematically illustrating the heating and fixing apparatus 62 shown in FIG. 1. FIG. 3 is a diagram illustrating the heating and fixing apparatus 62 shown in FIG. 1, as viewed from an introduction side of the recording material P.

The heating and fixing apparatus 62 is a so-called tensionless apparatus of a pressure roller driving type and a film heating type that rotates a pressure roller (backup member) 20 to rotate the fixing film (endless belt) 10 using the conveyance force of the pressure roller 20.

The heating and fixing apparatus 62 according to this embodiment includes a heater 30, serving as a heating unit, a cylindrical fixing film 10, serving as a heating rotating body (flexible member), and a heater holder 41, serving as a heating unit holding member. The heating and fixing apparatus 62 further includes a pressure stay 42, serving as a rigid pressure member, a pressing unit 43, serving as a pressure applying unit, and a fixing flange 45, serving as a member for regulating the end of the fixing film 10, that is, a regulating member for regulating the movement of the fixing film 10 in the longitudinal direction. All of the heater 30, the fixing film 10, the heater holder 41, the pressure stay 42, and the pressure roller 20 are members elongated in the longitudinal direction.

2-1) Fixing Film

Figure 4:
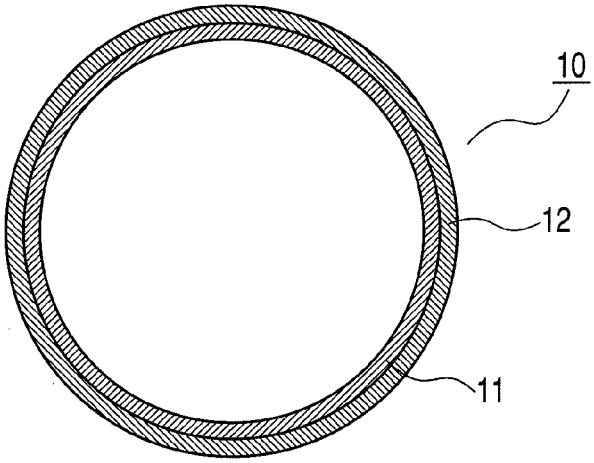
FIG. 4 is a transverse cross-sectional view schematically illustrating a fixing film.

FIG. 4 is a transverse cross-sectional view schematically illustrating the fixing film 10.

The fixing film 10 includes a base layer 11 that is made of a material having heat resistance and flexibility and has an endless sleeve shape and a release layer 12 that is provided on an outer circumferential surface of the base layer 11. In addition, an elastic layer (not shown), such as silicon rubber, may be provided between the outer circumferential surface of the base layer 11 and an inner circumferential surface of the release layer 12 in order to improve a fixing performance and image quality.

The base layer 11 is made of a metal material having heat resistance, flexibility, and high thermal conductivity, such as SUS (stainless steel) or Ni (nickel), and has a thick endless sleeve shape with a thickness of about 15 to 100 μm.

That is, the base layer 11 is made of a metal material having at least flexibility, such as SUS or Ni, and has an endless sleeve shape.

As the release layer 12, fluororesin, such as PFA, PTFE, or FEP, or a mixture thereof is coated on the outer circumferential surface of the base layer 11, or a tube coated with fluororesin is used. PFA means perfluoroalkoxy resin, PTFE means polytetra-fluoroethylene resin, and FEP means tetrafluoroethylene-hexafluoropropylene resin.

The thickness of the release layer 12 needs to be equal to or greater than 5 μm in terms of durability. When the thickness of the release layer 12 is excessively large, thermal conductivity is lowered and a fixing performance deteriorates. Therefore, the thickness of the release layer 12 needs to be equal to or less than 50 μm. As described above, in order to obtain high durability and a good fixing performance, the thickness of the release layer 12 is equal to or greater than 5 μm and equal to or less than 50 μm.

When an elastic layer 13 is provided between the outer circumferential surface of the base layer 11 and the inner circumferential surface of the release layer 12, it is possible to wrap a non-fixed toner image T carried on the recording material P and uniformly apply heat to the non-fixed toner image. Therefore, it is possible to prevent the irregularity of, for example, a halftone image caused by an uneven portion formed on the recording material P and the toner image T. As a result, it is possible to obtain a uniform and sufficient fixing performance.

The outside diameter of the fixing film 10 may be small in order to reduce thermal capacity. However, if the outside diameter is excessively small, the width of the nip portion F is reduced. Therefore, it is not preferable that the outside diameter be too small.

Therefore, in the fixing film 10 according to this embodiment, the base layer 11 is made of SUS, and has a thickness of 35 μm and an inside diameter of 30 mm, considering conditions, such as the speed (process speed) of the image forming apparatus. The release layer 12 is made of PFA by coating and the thickness of the release layer 12 is 14 μm.

2-2) Heater Holder

The heater holder 41 is made of a heat-resistant resin, such as liquid crystal polymer, phenol resin, PPS, or PEEK, and has a semicircular shape in a transverse cross-sectional view. As the thermal conductivity of the heater holder 41 is reduced, the thermal efficiency of the heater 30 heating the surface of the fixing film 10 is increased. Therefore, hollow fillers, such as glass balloons or silica balloons, may be contained in the heat-resistant resin forming the heater holder 41. A concave groove 41*a* is formed in the lower surface of the heater holder 41 (a surface facing the pressure roller 20) in the longitudinal direction of the heater holder 41. The concave groove 41*a* holds a substrate 31 of the heater 30 such that a protective sliding layer 34, which will be described below, of the heater 30 is exposed through the groove 41*a*. The fixing film 10 is loosely fitted to the heater holder 41. An apparatus frame (not shown) holds both ends of the heater holder 41 into which the fixing film 10 is fitted in the longitudinal direction of the heater holder 41.

2-3) Pressure Roller

The pressure roller 20 includes a core shaft 23, an elastic layer 22 that is provided on an outer circumferential surface of the core shaft 23, and a release layer 21 that is provided on an outer circumferential surface of the elastic layer 22.

The core shaft 23 is a round shaft that is made of aluminum or iron. The material forming the core shaft 23 is not limited to aluminum or iron, but the core shaft may be made of a ceramic porous material having high strength, low heat capacity, and a high insulating effect.

The elastic layer 22 is formed of, for example, silicon rubber (solid rubber layer) or a sponge layer formed by foaming silicon rubber in order to obtain an insulating effect. The elastic layer 22 is not limited to the silicon rubber or the sponge layer, but it may be, for example, a porous bubble rubber layer formed by adding hollow fillers, or absorbent polymer and water to a silicon rubber layer in order to obtain a higher insulating effect. The release layer 21 made of fluororesin, such as perfluoroalkoxy resin (PFA), polytetra-fluoroethylene resin (PTFE), or tetrafluoroethylene-hexafluoropropylene (FEP), is formed on the elastic layer 22. A member formed by coating a tube with resin or a member having a surface coated with paint may be used as the release layer 21.

The pressure roller 20 is arranged below the fixing film 10 so as to be opposite the heater 30 held by the heater holder 41. In the pressure roller 20, both ends of the core shaft 23 in the longitudinal direction thereof are rotatably held by the apparatus frame.

In the heating and fixing apparatus 62 mounted to the image forming apparatus that is operated at a relatively high speed, it is possible to form the nip portion F having an appropriate nip width and it is necessary to ensure a certain level of heat capacity. Therefore, in the pressure roller 20, the elastic layer 22 is made of solid rubber with a thickness of 3.5 mm. As the release layer 21, a tube that is coated with PFA and has a thickness of 50 μm is used considering durability. In addition, the outside diameter ϕ of the pressure roller 20 is 30 mm.

2-4) Heater

Figure 5:
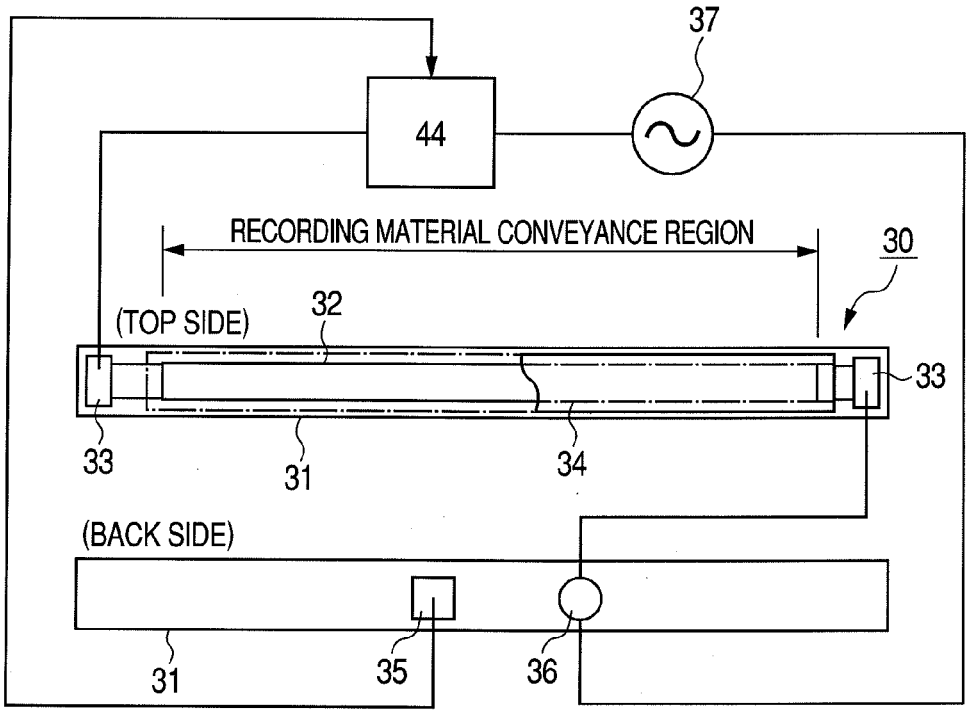
FIG. 5 is a diagram schematically illustrating the structure of an example of a heater.

FIG. 5 is a diagram schematically illustrating the structure of an example of the heater 30.

The heater 30 is a plate-shaped heating unit that rapidly heats the fixing film 10 while coming into contact with the inner circumferential surface of the fixing film 10 (the inner circumferential surface of the base layer 11). The heater 30 includes the substrate 31 that is elongated in the longitudinal direction. The substrate 31 is an insulating ceramic substrate made of, for example, alumina or aluminum nitride, or a heat-resistant resin substrate made of, for example, polyimide, PPS, or liquid crystal polymer. For example, Ag/Pd (silver/palladium), RuO2, or Ta2N is coated on the surface of the substrate 31 (the surface facing the pressure roller 20) in the longitudinal direction of the substrate 31 by, for example, a screen printing method to form an electric heating resistor layer 32 in a linear shape or a strip shape. The electric heating resistor layer 32 has a thickness of about 10 μm and a width of about 1 to 5 mm. In addition, feed electrodes 33 that supply power to the electric heating resistor layer 32 are provided on the insides of both ends of the substrate 31 in the longitudinal direction. In addition, a protective sliding layer 34 that protects the electric heating resistor layer 32 such that the thermal efficiency of the electric heating resistor layer 32 is not lowered may be formed on the surface of the substrate 31. However, the thickness of the protective sliding layer 34 may be sufficiently small for the electric heating resistor layer 32 to have a good surface property. In many cases, the protective sliding layer 34 is made of a heat-resistant resin, such as polyimide or polyamide-imide, or glass coat.

In the heater 30, when the substrate 31 is made of, for example, aluminum nitride having high thermal conductivity, the electric heating resistor layer 32 may be formed on the rear surface of the substrate 31 (a surface opposite to the pressure roller 20).

2-5) Pressure Stay

The pressure stay 42 is made of a material having rigidity, such as metal, and has a U shape in a transverse cross-sectional view. The pressure stay 42 is arranged at the center of the upper surface of the heater holder 41 (a surface opposite to the pressure roller 20) in the lateral direction in the fixing film 10. Pressing portions 43, such as pressing springs, urge both ends of the pressure stay 42 in the longitudinal direction along the axial line of the pressure roller 20 through the fixing flange 45 held by the apparatus frame. Then, the surface of the substrate 31 of the heater 30 is pressed against the surface of the pressure roller 20 through the fixing film 10 such that the elastic layer 22 of the pressure roller 20 is elastically deformed along the substrate 31. In this way, the nip portion (fixing nip portion) F having a predetermined width required to heat and fix the toner image T is formed between the surface of the pressure roller 20 and the surface of the fixing film 10.

2-6) Heating and Fixing Operation of Heating and Fixing Apparatus

A rotation and temperature control unit 44, serving as a control unit, performs a predetermined rotation control sequence in response to a print instruction, and drives a motor M, which is a driving source, to rotate a driving gear G that is provided at the end of the core shaft 23 of the pressure roller 20 in the longitudinal direction. Then, the pressure roller 20 is rotated in the direction of an arrow at a predetermined circumferential speed (process speed). At that time, turning force acts on the fixing film 10 in a direction that is opposite to the rotation direction of the pressure roller 20 by frictional force between the surface of the pressure roller 20 and the surface of the fixing film 10 in the nip portion F. In this way, the fixing film 10 is rotated with the rotation of the pressure roller 20 such that the outer circumference of the heater holder 41 is rotated in the direction of an arrow at a circumferential speed that is substantially equal to that of the pressure roller 20, while the inner surface of the fixing film 10 comes into contact with the protective sliding layer 34 of the heater 30.

In addition, the rotation and temperature control unit 44 performs a predetermined temperature control sequence in response to a print instruction to supply power from a power source 37 to the electric heating resistor layer 32 through the feed electrodes 33 of the heater 30. When the power is supplied, the electric heating resistor layer 32 generates heat and the temperature of the heater 30 is rapidly increased to heat the fixing film 10. The temperature of the heater 30 is detected by a temperature detecting element 35, serving as a temperature detecting unit, such as a thermistor, that is provided on the rear surface of the substrate 31. The temperature detecting element 35 outputs a temperature detection signal of the heater 30 to the control unit 44. The temperature detecting element 35 is arranged in a region through which the recording materials P having various sizes that can be used by the printer certainly pass, in a recording material conveyance region of the nip portion F in the longitudinal direction of the heater 30. The rotation and temperature control unit 44 receives the temperature detection signal from the temperature detecting element 35, and controls the supply of power to the electric heating resistor layer 32 on the basis of the temperature detection signal such that the heater 30 maintains a predetermined temperature (target temperature). That is, the rotation and temperature control unit 44 appropriately controls, for example, the duty ratio or the number of pulses of a voltage applied to the electric heating resistor layer 32 on the basis of the temperature detection signal output from the temperature detecting element 35 such that the heater 30 maintains a predetermined temperature.

The recording material P having the non-fixing toner image T carried thereon is introduced into the recording material conveyance region of the nip portion F while the pressure roller 20 and the fixing film 10 are stably rotated and the temperature of the heater 30 is maintained at a predetermined value. The recording material P is conveyed while being pinched between the surface of the fixing film 10 and the surface of the pressure roller 20 in the nip portion F. During the conveyance process, the heat of the fixing film 10 heated by the heater 30 and the pressure of the nip portion F are applied to the recording material P, and the toner image T is fixed to the surface of the recording material P by the heat and pressure.

In this embodiment, the temperature detecting element 35 comes into contact with the rear surface of the substrate 31, but the invention is not limited thereto. The temperature detecting element 35 may be elastically contacted with the inner surface of the fixing film 10 by a supporting member, such as a leaf spring (not shown) made of, for example, SUS.

A thermoprotector 36, such as a thermoswitch or a temperature fuse, is provided on the rear surface of the substrate 31 of the heater 30. An input terminal (not shown) of the thermoprotector 36 is connected in series to the power source 37, and an output terminal (not shown) thereof is connected in series to the electric heating resistor layer 32 of the heater 30. Therefore, when the heater 30 is in a runaway state due to the failure of the temperature detecting element 35, the thermoprotector 36 detects an abnormal temperature of the heater 30, and cuts the supply of power to the electric heating resistor layer 32.

2-7) Fixing Flange

During the fixing operation described in 2-6), the fixing film 10 is rotated by the frictional force between the fixing film 10 and the pressure roller 20 rotated in the nip portion F. In some cases, the pressure roller 20 and the fixing film 10 are not completely parallel to each other, but they are likely to intersect each other at a small angle due to a manufacturing process. When an intersection angle is formed therebetween, the fixing film 10 is moved in the longitudinal direction by the intersection angle, and a positional deviation occurs. In addition, the nip width of the nip portion F is not uniform due to the difference between the pressing forces of the pressing units 45, such as pressing springs, at both ends of the fixing film 10 in the longitudinal direction. Further, a difference in the rotation speed of the fixing film 10 that is rotated with the feed of the pressure roller occurs at both ends of the fixing film 10 in the longitudinal direction. In this case, deviation force that allows the fixing film 10 to be moved in the longitudinal direction is likely to be generated. In addition, when the nip width of the nip portion F is not uniform due to unevenness in the thickness or the hardness of the elastic layer 22 of the pressure roller 20, a difference in the feed speed of the fixing film 10 occurs at both ends of the fixing film 10 in the longitudinal direction. In this case, deviation force that allows the fixing film 10 to be moved in the longitudinal direction is likely to be generated.

Each of the fixing flanges 45 has an end regulating surface 46, which is a plane facing the end surface 14 of the base layer 11 of the fixing film 10 (hereinafter, referred to as a film base layer end surface), and the end regulating surfaces 46 regulate the position of the fixing film 10 in the longitudinal direction thereof to prevent the deviation of the fixing film 10. A lubricant (not shown), such as grease, can be applied onto the end regulating surface 46 of the fixing flange 45 to reduce the sliding friction between the film base layer end surface 14 of the fixing film 10 and the end regulating surface 46.

(3) Shape of End Surface of Base Layer of Fixing Film

Figure 6:
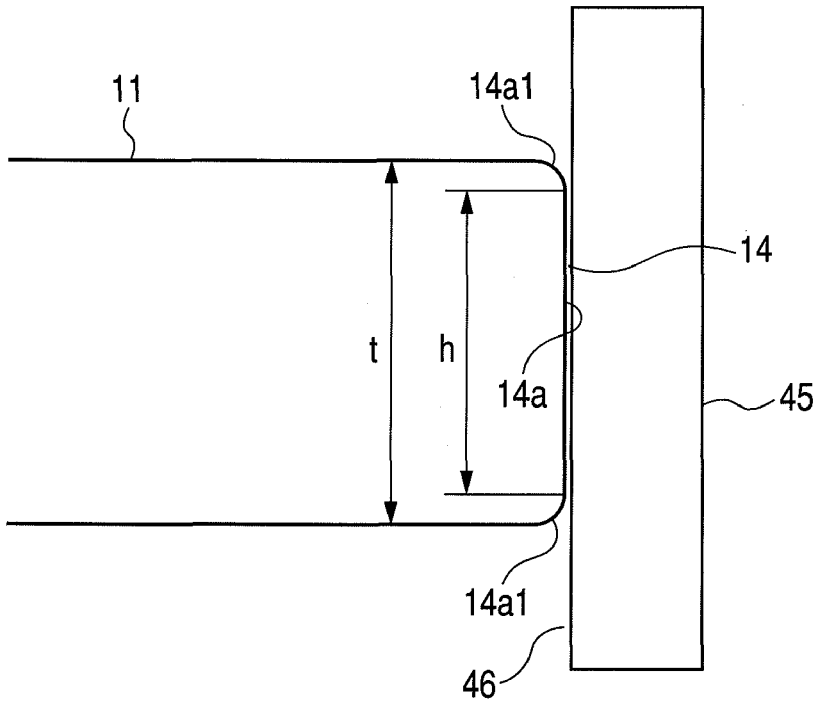
FIG. 6 is a partial enlarged view illustrating a portion A shown in FIG. 2, and shows a film base layer end surface of the fixing film and an end regulating surface of the fixing flange contacted with the film base layer end surface.

FIG. 6 is a partial enlarged view illustrating a portion A shown in FIG. 2. Specifically, FIG. 6 is a partial enlarged view illustrating the film base layer end surface 14 of the fixing film 10 and the end regulating surface 46 of the fixing flange 45 contacted with the film base layer end surface 14.

In this embodiment, in order to prevent the damage of the film due to deviation force, a contact area between the end regulating surface 46 of the fixing flange 45 and the film base layer end surface 14 of the fixing film 10 is increased.

Figure 12:
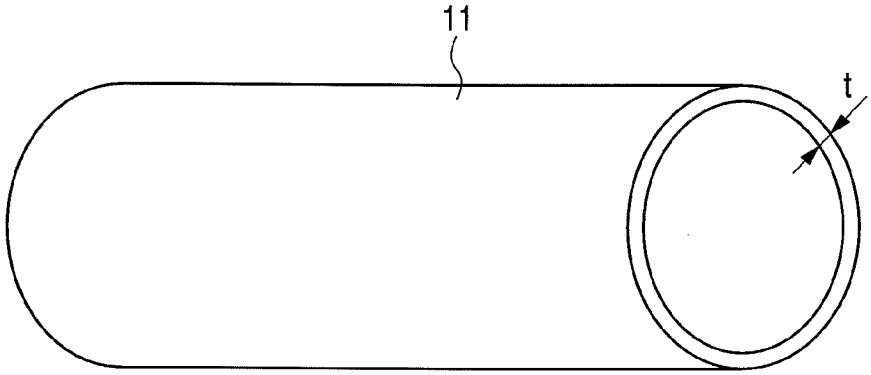
FIG. 12 is a perspective view illustrating the flatness ratio and the thickness of the base layer of the fixing film.

Specifically, as shown in FIGS. 2, 6, and 12, the film base layer end surface 14 of the fixing film 10 includes a plane region and a curved surface region. When the length of the plane region of the film base layer end surface 14 in the thickness direction of the base layer 11 is h and the thickness of the base layer 11 is t, a flatness ratio H is defined as follows: H=h/t. The flatness ratio H is set to a predetermined value or more.

When the flatness ratio H of the film base layer end surface 14 is defined as described above, it is possible to disperse stress to the entire film base layer end surface 14 contacted with the end regulating surface 46. Therefore, it is possible to prevent the damage of the film base layer end surface 14 due to the partial concentration of stress (hereinafter, referred to as film damage).

In addition, the generation of an intersection angle between the fixing film 10 and the pressure roller 20 due to a manufacturing process or the generation of an intersection angle due to a difference in the pressing force of the pressing unit 43 is considered. In some cases, the fixing film 10 contacts with the end regulating surface 46 of the fixing flange 45 at a small angle therebetween. In this case, stress is likely to be concentrated on a portion of the film base layer end surface 14. When the edge of the film base layer end surface 14 is inclined at an acute angle, stress is concentrated on a portion of the film base layer end surface 14, and a portion of the film base layer end surface 14 is cracked. As a result, the film is likely to be damaged.

Therefore, the film base layer end surface 14 includes a plane 14*a* contacted with the end regulating surface 46 of the fixing flange 45, and an edge 14*a*1 is rounded such that it does not come into point contact with the end regulating surface 46. As such, when the film base layer end surface 14 includes the plane 14*a* and the round (curved surface) edge 14*a*1, it is possible to prevent the fixing film 10 from being damaged due to the deviation of the fixing film 10 in the longitudinal direction. In addition, even when the fixing film 10 contacts with the end regulating surface 46 of the fixing flange 45 while being inclined at a small angle, it is possible to prevent stress from being concentrated on a portion of the edge 14*a*1 of the film base layer end surface 14. As a result, it is possible to prevent the film from being damaged.

For example, the following method may be used to round the edge of the film base layer end surface 14: a method of pressing the edge of the film base layer end surface 14 against an abrasive, such as a sand paper, provided such that the film base layer end surface 14 has a predetermined shape, while rotating the film base layer end surface 14. However, the method of rounding the edge is not limited thereto, but any method may be used as long as it can round the edge.

In order to examine the relationship between the flatness ratio H and the durability of the film base layer end surface 14, six fixing units provided with the fixing films 10 having different flatness ratios H were prepared.

In the six fixing units, the flatness ratios H of the film base layer end surfaces 14 of the fixing films 10 are 100%, 95%, 90%, 70%, 50% and 40%. In addition, in the six fixing units, a pressing spring having a tension of about 186 N (19 kgf) is used as the pressing unit 43. These fixing units were mounted to the image forming apparatuses and a sheet passing durability test was performed for 300,000 sheets. Then, it was checked whether an image defect occurred and whether the fixing film was damaged. The sheet passing durability test was performed using an image forming apparatus having a process speed of 266 mm/sec and a print speed of 45 pages per minute (hereinafter, referred to as 45 ppm) and using Extra80g (an A4 size, and a basis weight of 80 g/m2), which was plane paper, as the recording material.

The results are shown in Table 1. In Table 1, symbol 'O' indicates that a film is in a good state without being damaged, and symbol 'X' indicates that a film is damaged.

TABLE 1

| | Number of sheets passed | | | |
|---|---|---|---|---|
| Flatness ratio H | 50,000 sheets | 100,000 sheets | 200,000 sheets | 300,000 sheets |
| 100% | ○ | X | — | — |
| 95% | ○ | ○ | X | — |
| 90% | ○ | ○ | ○ | ○ |
| 70% | ○ | ○ | ○ | ○ |
| 50% | ○ | ○ | ○ | ○ |
| 40% | ○ | ○ | ○ | X |

When the flatness ratio H was 100% and 95%, the edge of the film base layer end surface had an acute angle, and stress was concentrated on the edge during the sheet passing durability test. As a result, a portion of the film in which the base layer end surface 14 was provided was damaged.

When the flatness ratio H was 40%, a plurality of cracks occurred in the film base layer end surface 14 after the sheet passing durability test was performed on about 230,000 sheets. As a result, the film was damaged. The reason is as follows: since the flatness ratio H of the film base layer end surface 14 is low, the effect of dispersing deviation force applied to the film base layer end surface 14 is lowered, and the film is damaged without enduring stress for a long time.

When the flatness ratio H was in the range of 50% to 90%, stress was not concentrated on a portion of the film base layer end surface since the edge of the film base layer end surface was sufficiently rounded, and stress was dispersed in the wide area of the film base layer end surface. Therefore, the film was not damaged during a long-time sheet passing durability test for 300,000 sheets, and a good result was obtained.

As can be seen from the above-mentioned results, when the edge of the film base layer end surface is rounded and the flatness ratio H is equal to or greater than 50% and equal to or less than 90% (50%≦H≦90%), it is possible to prevent the damage of the fixing film of the fixing unit.

Therefore, in the heating and fixing apparatus according to the first embodiment, even when strong deviation force is applied to the fixing film 10, it is possible to increase the contact area between the plane 14*a* of the film base layer end surface 14 of the fixing film 10 and the end regulating surface 46 of the fixing flange 45. In addition, since the edge 14*a*1 of the film base layer end surface 14 is rounded, it is possible to prevent stress from being concentrated on a portion of the film base layer end surface 14. In this way, even when the deviation force of the fixing film 10 is increased due to an increase in the process speed and the life span of an image forming apparatus, it is possible to prevent the damage of a film.

Second Embodiment

A heating and fixing apparatus according to another embodiment will be described.

In a heating and fixing apparatus according to a second embodiment, the same members and portions as those in the first embodiment are denoted by the same reference numerals, and a description thereof will be omitted. This is similarly applied to a third embodiment.

Figure 7:
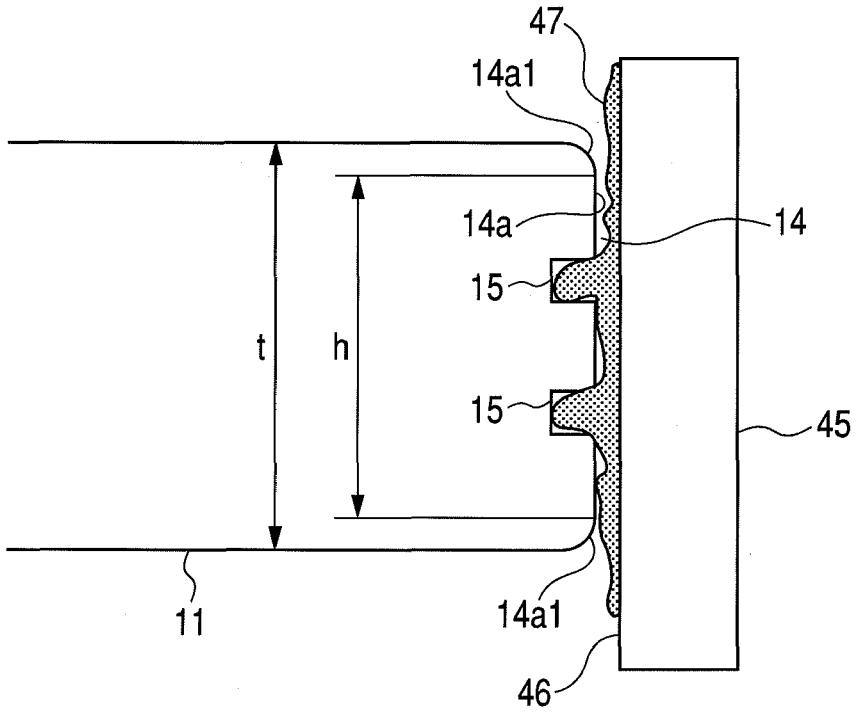
FIG. 7 is a partial enlarged view illustrating a film base layer end surface of a fixing film and an end regulating surface of a fixing flange contacted with the film base layer end surface in a heating and fixing apparatus according to a second embodiment.

FIG. 7 is a partial enlarged view illustrating a film base layer end surface 14 of a fixing film 10 and an end regulating surface 46 of a fixing flange 45 contacted with the film base layer end surface 14 in a heating and fixing apparatus 62 according to the second embodiment.

The heating and fixing apparatus 62 according to the second embodiment can improve a sliding property between the end regulating surface 46 of the fixing flange 45 and the film base layer end surface 14 of the fixing film 10 to prevent the damage of a film.

For example, in order to achieve the heating and fixing apparatus 62 capable of corresponding to an increase in the process speed of an image forming apparatus, generally, a pressing unit 43 that applies pressure to the nip portion F is reinforced to ensure a fixing property. When the pressing unit is reinforced to increase pressure applied to the nip portion, deviation force generated due to an intersection angle between the pressure roller 20 and the fixing film 10 is increased.

When the life span of the heating and fixing apparatus 62 is increased, sliding friction continuously occurs between the protective sliding layer 34 of the heater 30 and the inner surface of the base layer 11 of the fixing film 10 for a long time. As a result, the surface properties thereof deteriorate, and the friction therebetween is increased. When the friction is increased, the deviation force applied to the fixing film 10 is increased.

As such, when the heating and fixing apparatus 62 corresponds to an increase in processing speed or an increase in life span, deviation force applied to the fixing film 10 is increased, and strong stress is applied to the film base layer end surface 14. It is possible to prevent the damage of a film due to strong stress by increasing the thickness of the film base layer 11.

However, in this state, when it is difficult for the film base layer end surface 14 to smoothly slide on the end regulating surface 46 of the fixing flange 45, the intersection angle between the fixing film 10 and the pressure roller 20 is likely to increase. When the intersection angle is increased, the contact area between the film base layer end surface 14 and the end regulating surface 46 of the fixing flange 45 is reduced, and very strong deviation force is applied to a portion of the base layer end surface 14. As a result, a film is likely to be damaged. In this case, only an increase in the thickness of the base layer 11 of the fixing film 10 is not sufficient to prevent the damage of the film. In order to prevent the damage of the film, it is necessary to continuously bring the film base layer end surface 14 into smooth sliding contact with the end regulating surface 46 of the fixing flange 45 for a long time.

Therefore, in the fixing film 10 according to the second embodiment, the base layer 11 is made of SUS, and has a thickness of 42 μm and an inside diameter of 35 mm, considering conditions, such as the speed (process speed) of the image forming apparatus or the life span of the heating and fixing apparatus. The release layer 12 is made of PFA by coating and the thickness of the release layer 12 is 16 μm.

In addition, similar to the first embodiment, the flatness ratio H of the film base layer end surface 14 is set in the range of 50% to 90%, and the edge 14*a*1 of the film base layer end surface 14 is rounded. That is, similar to the first embodiment, in the second embodiment, the end surface of the base layer of the film includes a plane region and a curved surface region. The film base layer end surface 14 according to the second embodiment differs from that according to the first embodiment in that arc-shaped grooves 15 (FIG. 7) are formed as concave portions in the film base layer end surface 14 so as to correspond to the curvature of the fixing film 10 in the circumferential direction.

As shown in FIG. 7, two grooves 15 are formed in the plane 14*a* of the film base layer end surface 14. The two grooves 15 each have an opening size of about 2 μm in the thickness direction of the fixing film 10 and a depth of about 2 μm in the longitudinal direction of the fixing film. When the grooves 15 are formed in the film base layer end surface 14, it is possible to hold a lubricant 47, such as grease, applied onto the end regulating surface 46 of the fixing flange 45 in the grooves 15. The grooves 15 may be formed by any of the following methods: a method of using a laser marker to radiate a beam to the film base layer end surface 14 of the fixing film 10 that is rotated and held in a concentric shape; and a method of performing etching with chemicals.

The lubricant 47 held in the grooves 15 enables smooth sliding contact between the film base layer end surface 14 and the end regulating surface 46 of the fixing flange 45 even when a sheet passing operation is performed for a long time. Therefore, it is possible to prevent the damage of a film.

In order to check the effects of the grooves 15 provided in the film base layer end surface 14, which were characteristic components of the fixing film 10 of the heating and fixing apparatus 62 according to the second embodiment, a sheet passing durability test was performed to examine whether the fixing film was damaged. In the fixing film of the heating and fixing apparatus used for the sheet passing durability test, two grooves each having an opening size of 2 μm in the thickness direction of the base layer and a depth of 2 μm in the longitudinal direction of the fixing film are formed in the plane of the film base layer end surface. Fluorine-based grease is applied as a lubricant onto the end regulating surface of the fixing flange on which the film base layer end surface of the fixing film slides.

The pressing force of the nip portion of the heating and fixing apparatus used for the sheet passing durability test is about 226 N (23 kgf). The sheet passing durability test was performed using an image forming apparatus having a process speed of 311 mm/sec and a print speed of 52 pages per minute (hereinafter, referred to as 52 ppm) and using Extra80g (an A4 size, and a basis weight of 80 g/m$^2$), which was plane paper, as the recording material. The sheet passing durability test was performed on 400,000 sheets under the above-mentioned conditions to whether the fixing film 10 was damaged.

The sheet passing durability test results showed that no crack occurred in the film base layer end surface 14 after the sheet passing durability test. It is necessary to maintain smooth sliding contact between the film base layer end surface of the fixing film and the end regulating surface of the fixing flange for a long time under the above-mentioned sheet passing durability test conditions. In the fixing film 10 according to the second embodiment, it is possible to hold the sliding grease 47 in the grooves 15 provided in the plane 14*a* of the film base layer end surface 14. Therefore, the grease 47 flows out little by little from the grooves 15 of the film base layer end surface 14 to the friction portion, and it is possible to maintain the smooth sliding contact between the fixing film 10 and the end regulating surface 46 of the fixing flange 45. As a result, it is possible to prevent the damage of the fixing film even in a heating and fixing apparatus having a high process speed and a long life span.

In the second embodiment, each of the size of the opening of the groove 15 and the depth thereof is 2 μm, but the dimensions of the groove are not limited thereto. For example, the size of the opening of the groove 15 and the depth thereof may be in the range of 1 to 5 μm as long as the groove can hold the lubricant 47. In addition, the number of grooves 15 may be one or three or more. In this embodiment, the groove 15 is continuously formed in the plane 14*a* of the film base layer end surface 14 so as to be concentric with the fixing film 10 in the circumferential direction of the fixing film 10, but the shape of the groove is not limited thereto. For example, the groove may be discontinuously formed in the circumferential direction. That is, the groove may be connected to another arc-shaped groove, or a plurality of grooves may be discontinuously formed in the circumferential direction. For example, the groove 15 can be formed in the concentric direction by pressing the film base layer end surface 14 of the fixing film 10 that is concentrically rotated and held against a bristle brush or sand paper.

Third embodiment

A heating and fixing apparatus according to another embodiment will be described.

A third embodiment relates to a heating and fixing apparatus 62 in which a fixing film 10 includes a thin base layer 11 in order to correspond to an increase in process speed and an increase in life span and reduce a manufacturing cost and a size.

In order to prevent the damage of a film in the heating and fixing apparatus 62 corresponding to the increase in process speed and the increase in life span, the smooth sliding contact between the film base layer end surface 14 and the end regulating surface 46 of the fixing flange 45 needs to be maintained, regardless of the thickness of the base layer 11 of the fixing film 10. Therefore, it is necessary to form a concave portion, such as a groove, capable of holding the grease 47 applied onto the end regulating surface 46 of the fixing flange 45 in the film base layer end surface 14.

However, when the thickness of the base layer 11 is small, it is difficult to round the edge of the film base layer end surface 14, provide a groove having a width of about 2 to 5 μm in the concentric direction in the film base layer end surface 14, and maintain the flatness ratio H in a predetermined range, due to a variation in manufacture.

Therefore, in the third embodiment, circular concave portions 16 (FIGS. 8A and 8B) that have a diameter of about 5 μm and do not contact with the end regulating surface 46 are continuously provided in the plane 14*a* of the film base layer end surface 14 in the concentric direction of the film base layer end surface 14.

Figure 8A:
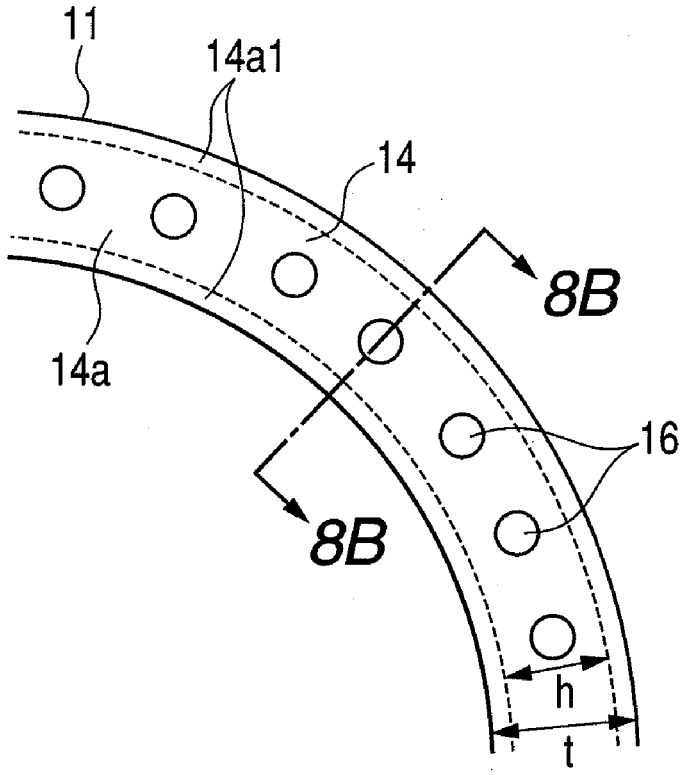
FIG. 8A is a diagram illustrating concave portions provide in a film base layer end surface of a fixing film in a heating and fixing apparatus according to a third embodiment.
Figure 8B:
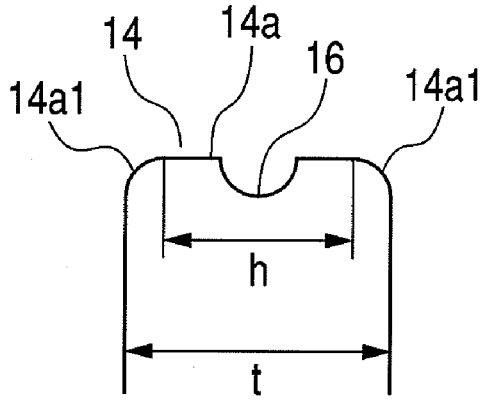
FIG. 8B is a cross-sectional view illustrating the film base layer end surface taken along the line 8B-8B of FIG. 8A.

FIG. 8A is a diagram illustrating the concave portions provided in the film base layer end surface 14 of the fixing film 10 in the heating and fixing apparatus according to the third embodiment, and FIG. 8B is a cross-sectional view illustrating the film base layer end surface 14 taken along the line 8B-8B of FIG. 8A. In the third embodiment, the flatness ratio H of the film base layer end surface 14 may be considered as the ratio of the sum of the area of the plane 14*a* and the area of all the circular concave portions 16 to the total area of the film base layer end surface 14.

Therefore, it is possible to adjust the radius of the circular concave portion 16 provided in the film base layer end surface 14 or the total number of concave portions 16 to stably set the flatness ratio H in a range capable of preventing the damage of a film while holding the grease 47 on the film base layer end surface 14.

In addition, any of the following methods may be used to form the circular concave portions 16 in the film base layer end surface 14: a method of using a laser marker; and a method of using a sand blaster. When the laser marker is used, it is possible to control the output of a laser or the diameter of a spot to adjust the depth and the radius of the circular concave portion 16. When the sand blaster is used, it is possible to control particle blasting force or the diameters of particles to adjust the depth and the radius of the circular concave portion.

In the third embodiment, the concave portion 16 provided in the film base layer end surface 14 has a circular shape, but the shape of the concave portion 16 is not limited thereto. For example, the concave portion may have a rectangular shape or a triangular shape. For example, when the laser marker is used, it is possible to radiate a beam to change the shape of the concave portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-101398, filed Apr. 9, 2008, which is hereby incorporated by reference herein in its entirety.

What is claimed is:

1. An image heating apparatus for heating an image formed on a recording medium, comprising:

an endless belt that includes a base layer made of a metal material;

a heater that contacts with an inner surface of the endless belt; and a backup member that forms a nip portion together with the heater through the endless belt, wherein the image formed on the recording medium is heated while being pinched and conveyed in the nip portion, an end surface of the base layer includes a plane region and a curved surface region, and wherein in a case where t denotes the thickness of the base layer, h denotes the width of the plane region in a thickness direction of the base layer, and the flatness ratio H of the end surface of the base layer is defined as h/t, the flatness ratio H satisfies $50\% \leqq H \leqq 90\%$.

2. An image heating apparatus according to claim 1, wherein the base layer is made of stainless steel or nickel.

3. An image heating apparatus according to claim 1, wherein a groove is provided in the end surface of the base layer in a circumferential direction of the endless belt.

4. An image heating apparatus according to claim 1, wherein a plurality of concave portions is provided in the end surface of the base layer in a circumferential direction of the endless belt.

5. An endless belt for use in an image heating apparatus, comprising:

a base layer made of a metal material, wherein an end surface of the base layer includes a plane region and a curved surface region, and wherein t denotes the thickness of the base layer, h denotes the width of the plane region in a thickness direction of the base layer, and the flatness ratio H of the end surface of the base layer is defined as h/t, the flatness ratio H satisfies $50\% \leqq H \leqq 90\%$.

6. An endless belt according to claim 5, wherein the base layer is made of stainless steel or nickel.

7. An endless belt according to claim 5, wherein a groove is provided in the end surface of the base layer in a circumferential direction of the endless belt.

8. An endless belt according to claim 5, wherein a plurality of concave portions is provided in the end surface of the base layer in a circumferential direction of the endless belt.

* * * * *